US006323488B1

(12) United States Patent
McCavit et al.

(10) Patent No.: US 6,323,488 B1
(45) Date of Patent: Nov. 27, 2001

(54) ADJUSTABLE MOTION SENSING APPARATUS

(75) Inventors: Kim Irwin McCavit, St. Joseph, MI (US); Bradford Brian Jensen, Bowling Green, KY (US); Wai-Shing Peter Ko, Chapel Hill, NC (US)

(73) Assignee: Desa International, Inc., Bowling Green, KY (US)

( * ) Notice: Subject to any disclaimer, the term of this patent is extended or adjusted under 35 U.S.C. 154(b) by 0 days.

(21) Appl. No.: 09/326,407

(22) Filed: Jun. 4, 1999

(51) Int. Cl.[7] ..... G08B 13/193; F21U 23/00

(52) U.S. Cl. ..... 250/347; 250/353; 340/567; 362/276

(58) Field of Search ..... 250/347, 353, 250/342, 221, 222.1; 340/567, 600; 362/276, 802

(56) References Cited

U.S. PATENT DOCUMENTS 5,015,994 * 5/1991 Hoberman et al. ..... 340/567
5,128,654 * 7/1992 Griffin et al. ..... 340/567
5,590,953 1/1997 Haslam et al. .
5,757,004 5/1998 Sandell et al. .

* cited by examiner

*Primary Examiner*—Constantine Hannaher
*Assistant Examiner*—Albert Gagliaroi
(74) *Attorney, Agent, or Firm*—Jones, Day, Reavis & Pogue

(57) ABSTRACT

An infrared motion sensing apparatus mounted within the canopy of a decorative lighting fixture where the apparatus may be vertically adjusted. The apparatus comprises a pyroelectric infrared sensor located in a stationary base. Mounted over the sensor and movable in a vertical direction is a Fresnel lens array. The array is mounted to a frame that is constrained to ride on the base in a vertical direction in response to the rotation of a screw. The canopy has an opening to allow radiation to be received by the sensor and a second opening for a stem of the screw so that manipulation of the stem may take place without disassembly of any part of the lighting fixture.

6 Claims, 5 Drawing Sheets

(PROBLEM)

(PROBLEM)

ADJUSTABLE MOTION SENSING APPARATUS

BACKGROUND OF THE INVENTION

1. Field of the Invention

The present invention relates to a motion sensing apparatus, and more particularly, to an adjustable motion sensing apparatus for decorative light fixtures.

2. Description of the Related Art

Motion sensing devices have been used in lighting control systems and security alarms for a number of years. For example, motion sensing devices for non-decorative fights usually consist of a sensing head or housing that is mounted independently of the lighting fixture. These independent housings often using a ball and socket type joint allowing the sensing apparatus to be aimed in a specific manner to optimize and customize the coverage area over which motion detection occurs.

A problem has arisen with regard to decorative lighting products which are purchased for their aesthetic appeal. The goal of merging a motion sensing device with a decorative lighting product is difficult because there is a need to conceal the sensing device or, at least, to camouflage the device so that the aesthetic appearance of the decorative lighting fixture is not disturbed or the disturbance is minimized. Because of these restraints, the motion sensing device tended to be in a fixed location.

More recently, decorative lights with motion sensing devices have been marketed where the device is rotatable around a vertical axis. In this regard, see U.S. Pat. No. 5,590,953. The rotatable motion sensing device disclosed in this patent is applied to decorative brass products. However, on decorative die cast products, the location for a sensing apparatus is more limited and again has traditionally been of a fixed or stationary design.

Fixed motion sensing devices have undesirable limitations because the coverage pattern of such devices is also fixed. There are some situations in which it is desirable to have the ability to alter the coverage pattern. For example, if a decorative light fixture is to be attached to a house that is located close to a busy street, there may be a problem. The usual objective of a consumer purchasing such a fixture is to detect people moving toward or around the house, but not to detect vehicles moving back and forth on the street or people walking past on the public sidewalk. With fixed motion sensing devices, sensitivity was lowered because the extent of the pattern could not be changed. This, of course, has the disadvantage of reducing sensitivity to the motion of people which the motion sensing device was installed to detect in the first instance. A diagram of this problem is shown in FIG. 1.

Another situation causing difficulty is where the decorative light fixture is attached to a house located on a raised patch of ground or where the light is located by a door at the top of a staircase. In both cases, the ground or staircase slopes rapidly away from the house so that the motion sensing device covers an area too far away from the house. Movement closer to the house is simply under the "coverage". A diagram of this problem is shown in FIG. 2.

There is no easy solution to these problems because designing a motion sensing device that is aimed downwardly will reduce the extent of coverage in those situations where the fixture is in a more normal setting. To create speciality fixtures for different situations will require a greatly increased inventory at the retail level and a corresponding increase in cost.

Recently, an effort to solve this problem appeared in U.S. Pat. No. 5,757,004 wherein an adjustable motion detector is disclosed. There, the sensing element itself is vertically adjustable using a mechanism that may prove to be relatively expensive.

BRIEF SUMMARY OF THE INVENTION

The difficulties set forth in the related art have been resolved by the present invention which is an adjustable motion sensing apparatus that is relatively simple, inexpensive and reliable. The adjustable motion sensing apparatus may comprise a housing; a pyroelectric infrared sensor supported by the housing; a Fresnel lens movably mounted relative to the housing; and means supported by the housing and connected to the Fresnel lens for moving the lens. An object of the present invention is to provide a motion sensing apparatus that is vertically adjustable. Another aspect of the present is to provide a motion sensing apparatus that is simple and inexpensive. A further advantage of the present invention is to provide a motion sensing apparatus that is easy to operate from outside the housing, such as a light fixture, where the sensing apparatus may be located; there is no need to perform any disassembly of the fixture to cause adjustment. Still another aim of the present is to provide a motion sensing apparatus that is reliable and safe to use.

A more complete understanding of the present invention and other objects, aspects, aims and advantages will be gained from a consideration of the following description of the preferred embodiment read in conjunction with the accompanying drawings provided herein.

DESCRIPTION OF THE PREFERRED EMBODIMENT

Figure 1:
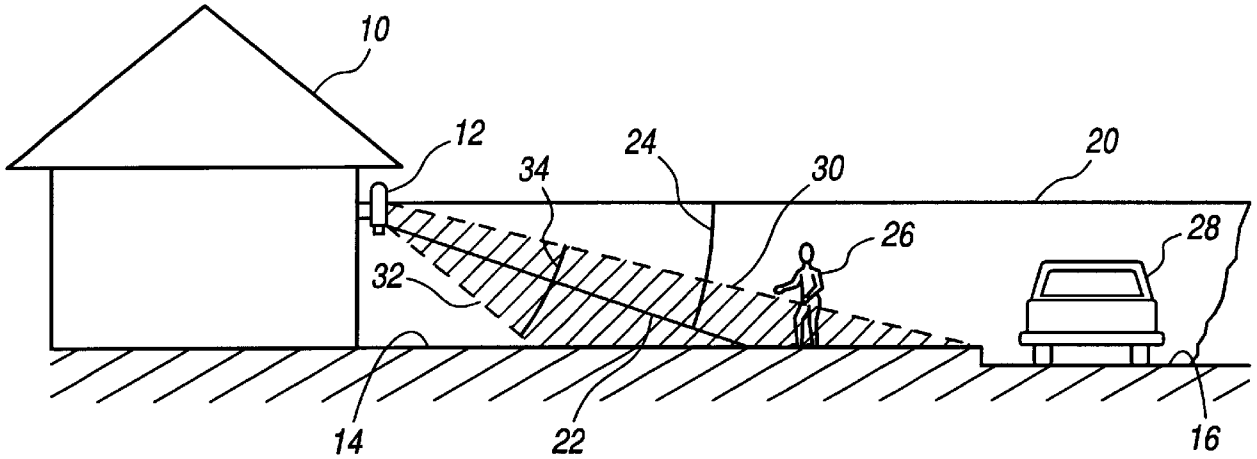
FIG. 1 is a diagrammatic view of a motion sensing pattern of a device mounted to house in a situation where the house is too close to a street.

While the present invention is open to various modifications and alternative constructions, the preferred embodiment shown in the drawings will be described herein in detail. It is understood, however, that there is no intention to limit the invention to the particular form disclosed. On the contrary, the intention is to cover all modifications, equivalent structures and methods, and alternative constructions falling within the spirit and scope of the invention as expressed in the appended claims.

Reference is now made to FIG. 1 which illustrates a problem with existing fixed position motion sensing devices. There is illustrated a house 10 having a fixture 12 with a motion sensing device, a walkway 14 and a street 16. The usual coverage pattern for the light sensing device (in a vertical direction) falls between a horizontal line 20 and an oblique line 22. Stated in another way, the arc of coverage is about 30° from a horizontal reference and is exemplified by the arc 24. As can be seen, this coverage includes a person 26 on the walkway 14 as well as an automobile 28 on the street 16. Generally, detection of the car 28 is not desirable, although detection of the person 26 is. A better detection pattern is shown by the region between an oblique dotted line 30 and an oblique dotted line 32 also making an arc of about 30° represented by the curve 34, but offset downwardly about 15° from the arc 24. The curve 34 is generally between 15° to 45° from the horizontal. As can be seen, this pattern of detection concentrates the sensing apparatus on the walkway 14 and not on the street 16. Thus, the sensing device will detect the person 26 but not the automobile 28.

Figure 2:
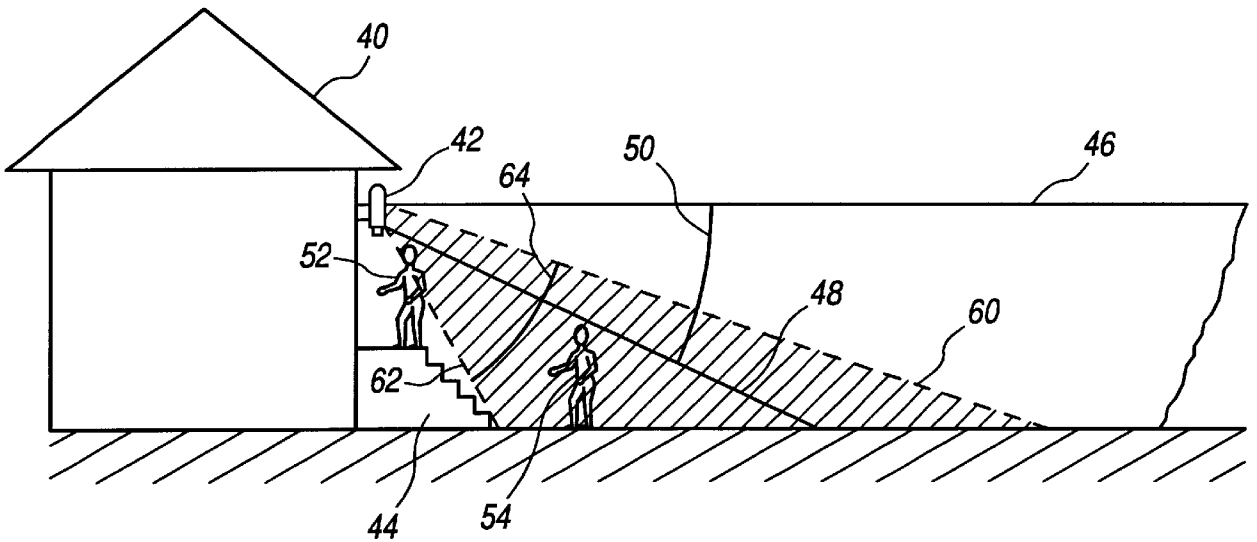
FIG. 2 is a diagrammatic view of a motion sensing pattern of a device mounted on a house having a long staircase.

FIG. 2 illustrates a house 40 to which is mounted a fixture 42 with a motion sensing device. In this situation, the device is mounted at the top of a long staircase 44 so that coverage falls between a horizontal line 46 and an oblique line 48. This field of view is represented by the arc 50 and is about 30°. Because the light is mounted by a front door of the house and the front door is at a relatively high elevation because of the staircase, the field of view of the device is too high. For example, the field of view will not detect a person 52 standing near the front door, nor a person 54 at the bottom of the staircase. A more desirable field of view is between an oblique dotted line 60 and an oblique dotted line 62, represented by the 30° field of view curve 64. If the field of view is adjusted downwardly, both the person 52 and the person 54 are detected. The problem illustrated in FIG. 2 would also exist if the house was located on a raised patch of ground.

Figure 3:
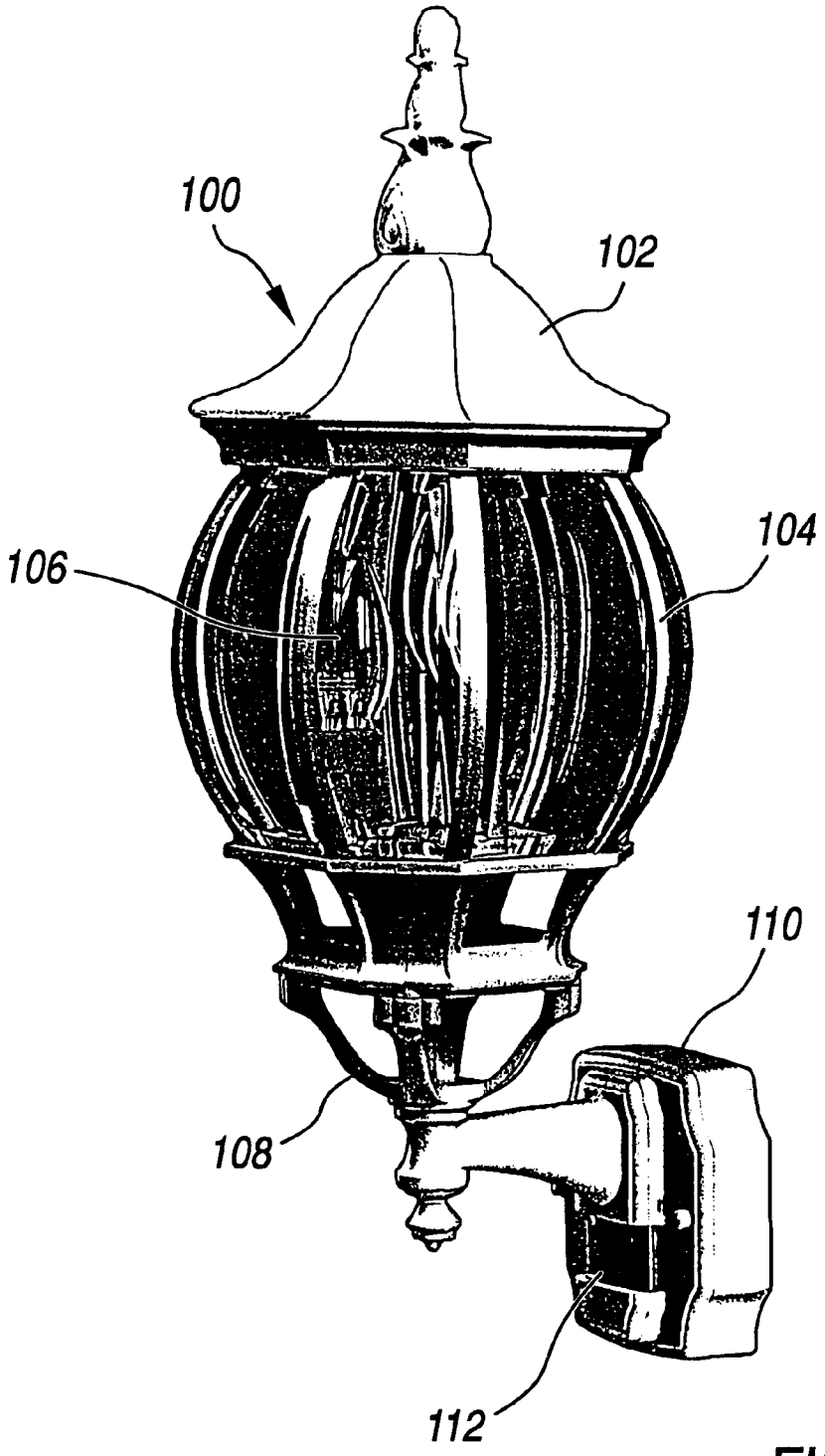
FIG. 3 is a perspective view of a cast aluminum lighting fixture having a motion sensing apparatus in a canopy.

Referring now to FIG. 3, there is illustrated a lighting fixture 100 in the form of a decorative cast aluminum lantern. The fixture includes a top cover 102, a glass enclosure or cage 104, containing one or more lamps, such as the lamp 106, and a base 108. This fixture body is mounted to a one piece cast bracket housing or canopy 110. Within the canopy is a motion sensing apparatus 112. The canopy is typically mounted to an outside wall of a dwelling, usually by a doorway and about seven feet from the landing next to the door.

Figure 4:
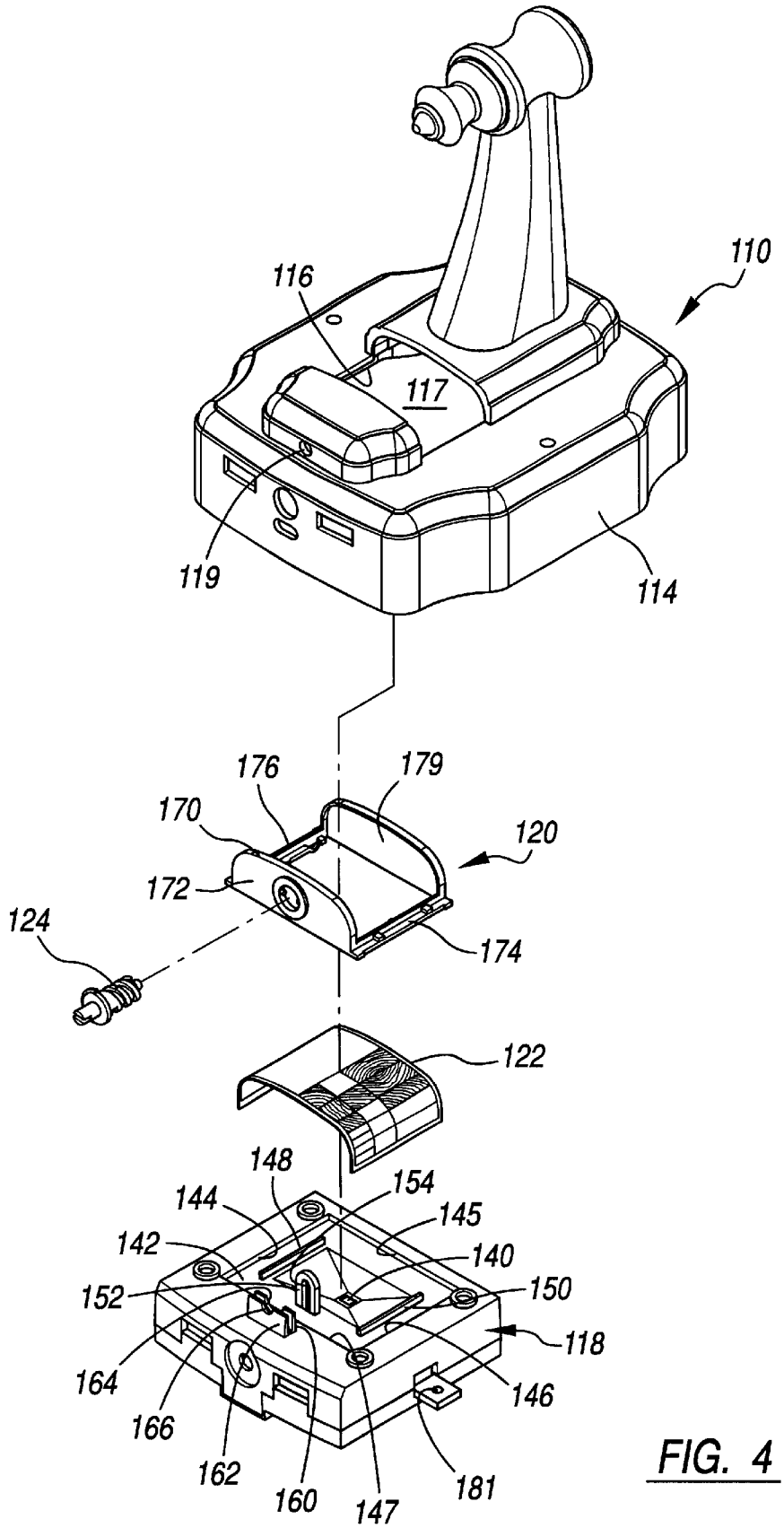
FIG. 4 is an exploded perspective view of the motion sensing apparatus from FIG. 3 illustrating a base, a Fresnel lens array, a lens frame, a screw system and a canopy.

Referring now to FIG. 4, the canopy 110 and the motion sensing apparatus 112 are shown in more detail. The canopy 110 may be made of die cast aluminum having an outer portion 114, an inner portion 116 and two openings, a window opening 117 and an adjustment opening 119. Mounted within the inner portion 116 of the canopy is a base 118 which encloses a pyroelectric infrared sensor or sensors and related circuitry (not shown). The pyroelectric infrared sensor is well known and, for example, has been described in publications issued by Mullard Limited of London, England and Amperex Electronic Corporation of the United States. The pyroelectric infrared sensor may include pyroelectric ceramic material and a low-noise electrical impedance matching circuit in a sealed encapsulation. Radiation is usually collected by a Fresnel lens array. This provides discrete fields of view from each element of the array to ensure significant changes in incident radiation when an intruder passes from an unmonitored gap to a monitored zone or vice versa. Fresnel lens arrays are relatively low cost and provide relatively high sensitivity, monitoring outward up to 30 to 50 feet with a 170° degree angular coverage. Different ranges can, of course, be created by altering the Fresnel lens array. A source of such sensors is Nippon Ceramics of Japan.

Mounted to the sensor base 118 is a lens frame 120, and attached to the lens frame is a Fresnel lens array 122. Moving the frame and lens array is a screw system 124. The lens array may be connected to the frame with any suitable adhesive.

The sensor base 118 is mounted to the canopy housing to access the opening 117 and to allow manipulation of the screw system 124 through the opening 119. The Fresnel lens array 122 occupies the opening 117 and provides access of incident radiation to the sensor.

Figure 5:
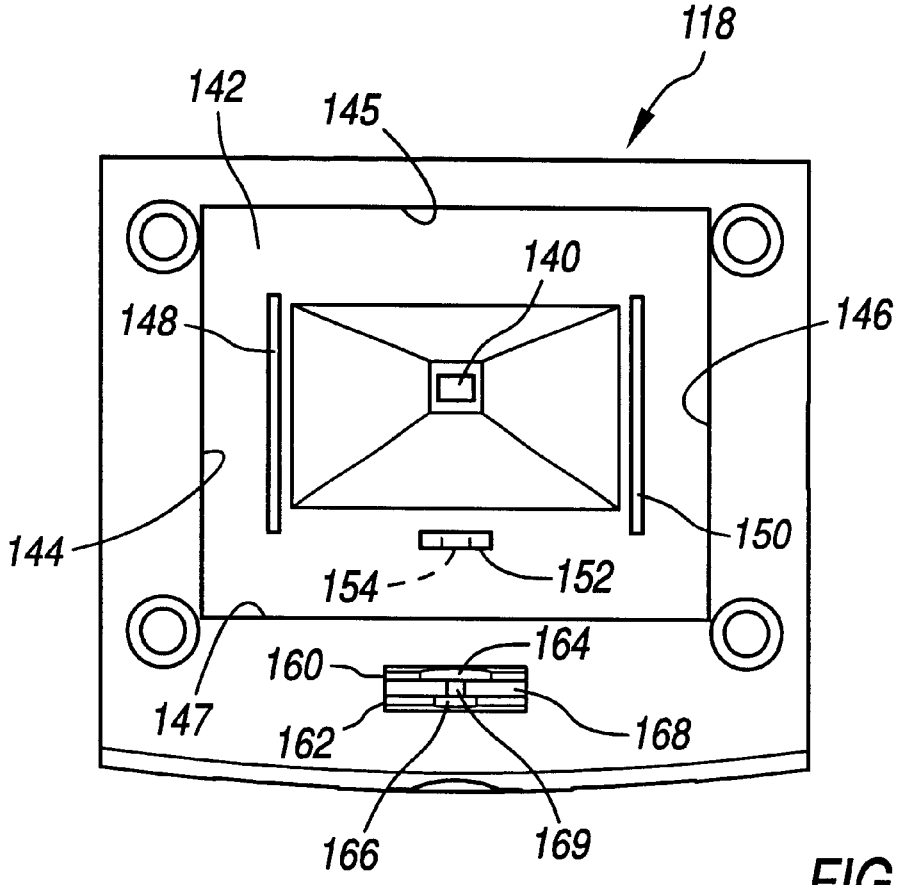
FIG. 5 is an elevation view of the base containing a pyroelectric infrared sensor and associated circuitry.
Figure 6:
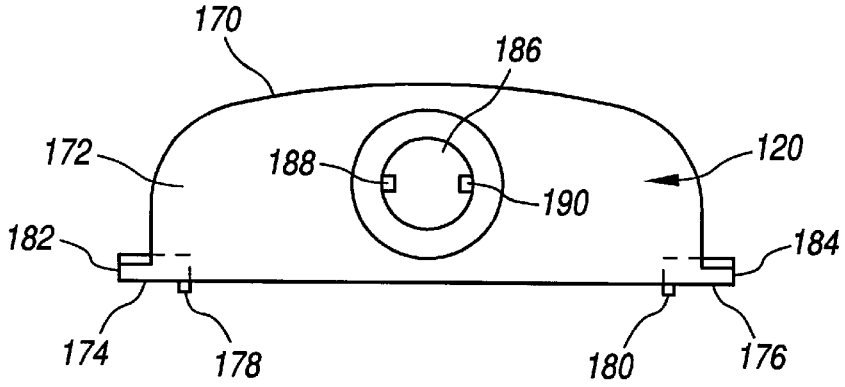
FIG. 6 is a bottom plan view of the lens frame of FIG. 4.
Figure 7:
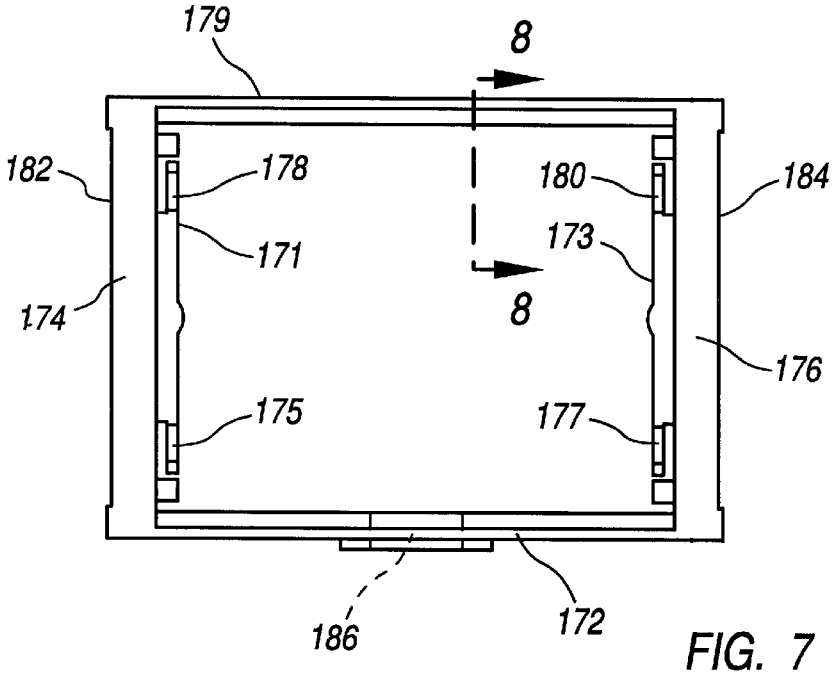
FIG. 7 is a back elevation view of the lens frame of FIGS. 4 and 6.
Figure 8:
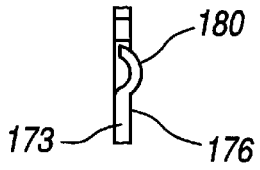
FIG. 8 is a partial side elevation view of the lens frame taken along line 8—8 of FIG. 7.

Referring now to FIGS. 4 and 5, the base 118 is disclosed in more detail. The infrared sensor and related circuitry are located within the base behind a window 140. Located around the window is a rectangular recess 142 bounded by side walls 144, 146, an upper wall 145 and a lower wall 147. As will be explained below, the recess has a width about equal to that of the width of the frame 120 and a height about 4–5 mm larger than the height of the frame. Positioned a short distance inward from the sidewalls 144 and 146, are two parallel guide flanges 148 and 150, respectively. Also located in the recess is a screw retention flange 152 having an opening 154. Beneath the retention flange 152 are two closely spaced cradle flanges 160 and 162 having first and second cradles portions 164 and 166, respectively. Positioned between the two cradle flanges is a slot 168 and a block flange 169.

Referring now to FIG. 4, 6, 7 and 8, the frame 120 is shown in more detail. The frame includes a bowed top ledge 170 which generally matches the shape of the Fresnel lens array 122, a bottom panel 172, a top panel 179 and back members 174 and 176. The back members include outer edges 182, 184 and inner edges 171, 173. Mounted to the back members are four resilient feet 175, 177, 178 and 180. About the center of the bottom panel 172 is an opening 186 and two projections 188 and 190 extending from the bottom panel into the opening. The distances between the side walls 144, 146 of the base recess 142 and the guide flanges 148, 150, respectively, are about equal to the width between the outer edges 182, 184 and the inner edges 171, 173 respectively, of the frame 120. When the frame is mounted to the base the back members are constrained so as to prevent lateral movement of the frame by the recess walls and the guide flanges. The resilient feet, such as the foot 180 extend to the recess surface and support the frame during vertical sliding movement along the recess. Also when the base, frame and array combination is connected to the canopy, such as by a fastener through an opening 181 in the base, slight pressure is placed on the bowed ledge by the canopy. This causes the frame to be pressed against the base recess. The feet are curved so as to flex and thereby create a biasing force toward the interior surface of the canopy. This prevents any rattling of the frame/array.

Figure 9:
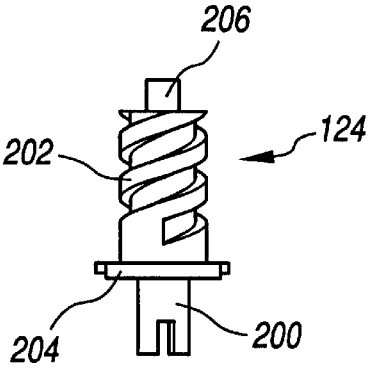
FIG. 9 is an elevation view of the adjustment screw system of the present invention shown in FIG. 4.

Reference is now made to FIG. 9 which illustrates the screw system 124. The screw system is an integral item made of any suitable plastic and includes a bottom stem portion 200, a threaded portion 202, a circular flange or washer 204, and a cylindrical head portion 206.

The motion sensing apparatus is assembled by having the screw system 124 threaded into the opening 186 of the frame whereby the threaded portion 202 engages the projections 188 and 190. The washer 204 is received in the slot 168 of the base while the stem portion 200 is received by the second cradle portion 166. The threaded portion 202 is received by the first cradle portion 164. Finally, the head portion 206 is inserted into the opening 154 of the flange 152. When these items are connected as just described, the screw system 124 is constrained to rotate only. The rotation of the threaded portion 202 of the screw causes the projections 188 and 190, as well as the frame to move vertically. In this fashion, the frame/array may move in a vertical direction in the recess to the extent of the difference in vertical dimension between the frame and the recess. In other words, the frame/array is moveable between the lower wall 147 and the upper wall 145. The difference in dimension in the preferred embodiment is approximately 4–5 mm. Thus, the lens array may be adjusted relative to the window 140 of the sensor by 4–5 mm.

It can now be appreciated that by rotating the stem 200 of the screw system, the relationship between the Fresnel lens array 122 and the infrared sensor represented by the window 140 may be altered. In the preferred embodiment, this alteration will allow the infrared sensor to have a field of view range between those represented by the curves 24 and 34 in the FIG. 1 diagram and by the curves 50 and 64 in the FIG. 2 diagram. Generally this range is from 0–30° to 15–45° where the 0° reference line is a horizontal line (the line 20 in FIG. 1 and the line 46 in FIG. 2) and the angle is measure in a clockwise direction.

After assembly of the lighting fixture in a factory and its packaging, the fixture is usually sold to a consumer who installs the fixture adjacent the front door of a house. Generally, houses have an electrical junction box mounted about seven feet from the landing in front of the front door. It is anticipated that the fixture will be installed by the consumer so that it is undesirable to require that the fixture be disassembled in any way. If the house is located a sufficient distance from a street or a parallel public sidewalk, and if the ground leading to the front door is relatively flat, there is no need to adjust the motion sensor. If, however, one or both assumptions are invalid, then the motion sensor may be easily adjusted from outside the fixture simply by rotating the stem portion of the screw system. To make the adjustment of the infrared sensing apparatus convenient, the stem 200 is mounted so as to be accessible though the opening 119 of the canopy 110 (FIG. 4). This allows the field of view of the motion sensor to be lowered so that radiation detection from the street or sidewalk does not activate the fixture. Also lowering the field of view will allow detection of people close to the house in the situation where the ground slops away from the house, or there is a stairway leading up to the front door.

In can now be appreciated that the fixture is very easy to install and adjust and that the function of the motion detection fixture is greatly enhanced.

The specification describes in detail an embodiment of the present invention. Other modifications and variations will, under the doctrine of equivalents, come within the scope of the appended claims. For example, changing the dimensions of the Fresnel lens array or the recess or the distance that the lens array travels in a vertical direction are considered equivalent structures. Also, altering the canopy and the location of the base and first opening or the distance between the lens array and the window are also considered equivalent structures. Still, other alternatives will also be equivalent as will many new technologies. There is no desire or intention here to limit in any way the application of the doctrine of equivalents.

What is claimed is:

1. An adjustable motion sensing apparatus comprising:

an outer housing having a first opening therein;

a base mounted to said housing adjacent said first opening;

a sensor mounted to said base;

a movable frame having a lens mounted thereto, said frame having a top surface, a bottom surface, opposing outside surfaces and opposing inside surfaces;

said base including a first pair of opposing side surfaces for guiding said opposing outside side surfaces of said frame, a second pair of opposing side surfaces for guiding said opposing inside side surfaces of said frame, a third surface for abutting said top surface of said frame for limiting movement of said frame in an upward direction, and a fourth surface for abutting said bottom surface of said frame for limiting movement of said frame in a downward direction; and means for moving said frame upwardly and downwardly.

2. An apparatus as claimed in claim 1 including:

a biasing element connected to said frame for pressing said frame against said housing in a direction generally perpendicular to the movement of said frame in an upward and downward direction.

3. An apparatus as claimed in claim 1 including:

a recess formed in said base, said first pair of opposing side surfaces forming the sides of the recess and said third and fourth surfaces forming the top and bottom surfaces, respectively, of said recess;

a pair of guide flanges formed in said recess, said guide flanges including said second pair of opposing side surfaces; and wherein said sensor is mounted in said recess.

4. An apparatus as claimed in claim 3 wherein:

said moving means includes a screw system having an integral washer;

said base includes two spaced apart cradle flanges, said washer being received between said two cradle flanges; and an opening formed in said frame for receiving said screw system.

5. An apparatus as claimed in claim 4 including:

a second opening in said outer housing; and wherein said screw system extends through said second opening.

6. An apparatus as claimed in claim 5 including:

a biasing element connected to said frame for pressing said frame against said housing.

* * * * *